US006124542A

United States Patent [19]

Wang

[11] Patent Number: 6,124,542

[45] Date of Patent: Sep. 26, 2000

[54] WAVEFUNCTION SOUND SAMPLING SYNTHESIS

[75] Inventor: Avery L. Wang, Palo Alto, Calif.

[73] Assignee: ATI International SRL, Barbados, St. Kitts/Nevis

[21] Appl. No.: 09/351,101

[22] Filed: Jul. 8, 1999

[51] Int. Cl.[7] ..... G10H 7/00

[52] U.S. Cl. ..... 84/603; 84/605

[58] Field of Search ..... 84/603–605

[56] References Cited

U.S. PATENT DOCUMENTS 4,108,036 8/1978 Slaymaker ..... 84/605
5,567,901 10/1996 Gibson et al. ..... 84/605 X
5,872,727 2/1999 Kuo ..... 84/603
5,952,596 9/1999 Kondo ..... 84/605

*Primary Examiner*—Jeffrey Donels
*Attorney, Agent, or Firm*—Skjerven Morrill MacPherson LLP

[57] ABSTRACT

A signal representation method and apparatus for digital audio provides high quality low cost resampling by transferring the difficult interpolative computations into front-end (off-line) preprocessing, thereby reducing the load on the tone generating synthesis processor. This allows nearly perfect arbitrary-ratio resampling of stored waveforms at a fraction of the cost of prior art resampling. It also allows elimination of the prior art polyphase coefficient table since the waveform reconstruction information is fully contained within the polynomials. This is especially advantageous for execution on general purpose multi-tasking media processors.

37 Claims, 9 Drawing Sheets

WAVEFUNCTION SOUND SAMPLING SYNTHESIS

BACKGROUND

1. Field of the Invention

This invention relates to digital signal processing and more specifically to electronic sound synthesizing by use of wavefunctions.

2. Related Art

Digital resampling sound synthesizers, also commonly known as "wavetable" synthesizers, have become widespread in consumer sound synthesizer applications, finding their way into video games, home computers, and karaoke machines, as well as in electronic performance musical instruments. They are generally known for their reproduction of realistic musical sounds, a consequence of the fact that the sounds are generated using digitally sampled Pulse Code Modulated (PCM) recordings of the actual musical instruments. The sound reproduction quality varies tremendously, however, depending on tradeoffs of sample storage space, computational cost, and quality of the analog signal circuitry.

The principle of operation is quite simple: sounds are digitally sampled and stored in some memory, such as ROM (read-only memory) for turn-key applications, and RAM (random-access memory, also known as read/write memory) for programmable configurations. RAM-based systems usually download the samples from a high-capacity storage device, such as a hard disk. To conserve memory, not every note of a given instrument is actually sampled in a practical sampling synthesizer. A complete recording of a musical instrument across all keys and velocities can easily consume several hundred megabytes of storage. Instead, notes are sampled at regular intervals from the full range of the instrument. The missing notes are reconstructed by contracting or expanding the actual samples in time, in order to raise or lower the pitch of the original recordings, respectively. It is well known that playing back a recording slower than its original sampling rate lowers the pitch, and conversely playing a recording back at a faster rate increases its pitch. Instead of actually playing back a raw sound recording at varying sample rates through a digital-to-analog converter (DAC) to shift the pitch, what is typically done in modern resampling synthesis is to stretch the stored recording of the note to a new sample rate (relative to the original PCM recording) and play out the new samples at a predetermined output rate. One major benefit is that several pitch-shifted notes may be played back simultaneously by resampling with different ratios but mixed together into a common PCM stream, which is sent to a single fixed-sample rate DAC. This method reduces hardware (circuitry) because it does not require a separate DAC for each individual note, making the incremental cost of the analog hardware to support polyphony essentially "free".

In order to effect such a resampling in the digital domain it is necessary to use interpolation techniques to resample the recording to the desired playback speed. There are several well-known techniques for resampling digital audio recordings. A technique that is used frequently for resampling is based on polyphase filtering (See *Multirate Digital Signal Processing,* R. E. Crochiere et al., Prentice Hall, 1983 and *Multirate Systems and Filter Bank,* p.p. Vaidyanathan, Prentice-Hall, 1993). One limitation of this technique is that the complexity of resampling calculations increases rapidly if the resampling ratio is not the ratio of small integers. For example, two popular sampling ratios used in digital audio are 44.1 KHz and 48 KHz: their ratio is 147/160. To convert from 44.1 to 48 KHz would require a polyphase filter with 160 phases. requiring large tables. Furthermore, since conversions are limited to rational resampling ratios, polyphase resampling is ill-suited to resampling synthesis, which requires a continuum of ratios for pitch-bending.

A way of overcoming the limitations of polyphase resampling is to use interpolated polyphase resampling, which can be used to obtain arbitrary-ratio sample rate conversions. (See e.g. "A Flexible Sampling—Rate Conversion Method", J. O. Smith and P. Gosset, *Proc. ICASSP,* p.p. 19.41–19.4.4, 1984; "Theory and VLSI Architectures for Asynchronous Sample—Rate Converter", R. Adams and T. Kwan, *J. Audio and Engineering Society,* Vol. 41, July 1, August 1993; and "*A Stereo Asynchronous Sample-Rate Converter for Digital Audio*", R. Adams and T. Kwan, *Symposium on VLSI Circuits, Digest of Technical Papers,* IEEE Cat. No. 93CH 330J-3, p.p. 39–40, 1993.) For a given re-sampling phase the closest two polyphase filters are chosen and linearly interpolated between using the fractional phase offset. Use of this technique is widespread in resampling for musical and other digital audio applications.

To perform accurate interpolated polyphase sample rate conversion there are two goals. One is that the model filter for the polyphase filterbank should be as close as possible to a $$\mathrm{sinc}(x) \triangleq \frac{\sin(\pi x)}{\pi x} \tag{1}$$

function, which is well-known to have a perfect "brick-wall" (vertical) transfer function, shown in FIG. 1. The length of the model filter determines the number of taps in the resulting FIR filter generated by the phase interpolation process. This ideal is unattainable since the sinc function has infinite extent in time. Typically, the model filter is a windowed sinc to keep the number of taps small—usually between 4 and 64, with obviously increasing deviations from the ideal as the number decreases. The other ideal is that the number of phases should be as large as possible so that interpolating between adjacent phases incurs as little error as possible. It is known that if N bits of accuracy in the FIR coefficient calculation are desired then the polyphase filterbank should have $\sqrt{2^N}$ phases.

Typical resampling synthesizer implementations use a small number of interpolated FIR taps to save computational cost. Lower-quality resampling synthesizers go so far as to use linear interpolation (two-point interpolation), which can result in significant aliasing and imaging artifacts due to the slow rolloff of attenuation in the stop band. The effective model filter resulting from linear interpolation has a transfer function shown in FIG. 2. It is known to use 7- or 8 -tap interpolating filters calculated using a 16-phase interpolated polyphase filter, (See "Digital Sampling Instrument For Digital Audio Data", D. Rossum, U.S. Pat. No. 5,111,72.) FIG. 3 shows the transfer function of the model filter with various cutoffs. Such an interpolating filter, though far from ideal, is considered to give acceptable-quality interpolation. In addition to problems in the stopband, low-order interpolating filters suffer from undesirable rolloff in the passband due to the wide transition band, as can be seen in FIGS. 2 and 3. This problem results in significant attenuation of signal energy, becoming most severe near the Nyquist frequency, potentially causing resampled musical note recordings to sound dull. This is compensated for in many resampling synthesizers by recording note samples at a higher-than-critical sampling rate, attempting to provide enough margin above the highest significant musical frequency components so that the undesired attenuation happens mostly where it is unimportant. A disadvantage of this strategy is that it requires more storage space to compensate for expanded data sets.

Computational Cost

Discrete-time, sampled representations are a highly useful representation of analog data with well-developed means of analysis and manipulation. Re-sampling a discrete-time signal conceptually converts a sample stream into an analog signal by convolving with a sinc function, followed by sampling at the new desired rate. Of course, a practical resampler does not actually perform the conversion to an analog signal—that would require an infinite amount of storage and computation. Rather, only the output samples that are actually desired are computed. Even so, as mentioned above, a major problem with discrete-time resampling is that the reconstruction process is non-localized due to the infinite extent of the kernel; that is to say, to calculate an arbitrary point $x(t_0)$ from the perfect reconstruction of a critically sampled waveform x[n], as guaranteed by the Nyquist theorem (see "Certain Topics in Telegraph Transmissions Theory", Nyquist, AIEE Trans, pp. 617–644, 1928), the entire sampled stream must be used, as seen in the sum $$x(t) = \sum_{k=-\infty}^{\infty} \operatorname{sinc}\left(\frac{t}{T} - k\right) x[k] \tag{2}$$

Even in the non-ideal case where the sinc(t) function is replaced by a model reconstruction filter h(t) of finite duration $$\tilde{x}(t) = \sum_{k=-N_h}^{N_h} h\left(\frac{t}{T} - k\right) x[k] \tag{3}$$

the reconstruction is still as non-localized as the support of h(t), which must be broad if high-quality resampling is desired.

If one wants a high-quality resampler, one must use many interpolation points, each of which requires one multiply-accumulate. In addition, the resampler must provide the coefficients, thus incurring more computations. The above-described method using a linearly interpolated sinc function requires one multiply and two adds per coefficient. For 8-point interpolation, we see that 16 multiplies and 24 adds are required per output sample. This expense is largely due to the non-locality of the PCM representation conventionally used in digital audio. What is desired is to find a localized, yet accurate representation of a continuous-time function: this is provided by the presently disclosed wavefunction process and apparatus.

Coefficient Tables

In addition to the computational cost associated with calculating interpolated filter coefficients, there is an "architectural" (circuitry) burden associated with using the large polyphase tables required for high-quality resampling. A large table is disadvantageous because it must be accessed twice per interpolated coefficient for each coefficient used for each sample: an N-point resampler must access the table 2N times per output sample produced. A fast-access memory is therefore required to store it. Special-purpose music synthesis and resampling chips have fast ROMs with special pipelined circuitry to provide the table values. The ROM access circuits usually take advantage of symmetry by folding the table in half and mirroring the access. For programmable circuits, such as DSPs (digital signal processors) or microprocessors, the large table must be held in a low-latency SRAM or level-1 cache. Usually, such resources are limited, restricting the size of the table.

To summarize, in designing a traditional resampling synthesizer, significant tradeoffs must be made between quality (frequency response and artifact suppression), and computational budget. Practical implementations using traditional techniques are generally computationally bound and thus must make do with lower-than-ideal quality, with skillful voicing necessary to avoid artifacts.

SUMMARY

Therefore in accordance with this invention there is provided a general arbitrary—ratio resampler, that is a digital resampling sound synthesizer, which calculates a waveform using a polynomial. It does this by dividing the relevant time into segments having a representation of a polynomial of equal degrees whereby several samples may be computed in parallel. The segments may be of equal length. An index is provided for time indexing the polynomial segments represented with the time normalized between an arbitrary length, for instance-1 to 1. One may introduce levels of hierarchy with transitions using partitioned sections. An arbitrary ratio resampler with adjustable ratio is provided using a spline method where the polynomial is represented as a spline or where the spline calculations are a cubic spline.

Alternatively in a segment fitting method using the polynomial the input signal is functionally defined as an input signal fitting to a pulse code modulation (PCM) signal. The fitting is provided where the input signal is up sampled to a high degree, then the polynomial fitting is performed.

The present playback method includes a variable-pitch playback accomplished by playing a sound back at a different rate than that of the original waveform. Thereby a range of (musical) note pitches can be produced from a single encoded waveform.

In the present sample rate conversion, the sampling time intervals may be taken at a different rate than that of the original PCM sample stream, but played back at the same pitch. Thereby the resampling computational load is shifted away from the decoder, to the encoder.

Thus, there are disclosed methods for encoding and playing back (decoding) a resampled audio waveform including providing a sequence of time points, associating a polynomial with each time point, calculating the sample value for each time point by evaluating the associated polynomial using the time point and then providing the generated sequence of sample values to an output element for actually generating the sound. Also in accordance with the invention there is an encoding method for generating a wave function signal representation including accepting an input waveform, determining a number of segments and determining various segmentation points by time, determining various polynomial degrees, and then for each segment fitting an M-th degree polynomial over the interval of time and storing the generated coefficients in a memory. Corresponding encoding and playback apparatuses are also within the invention.

DETAILED DESCRIPTION

Figure 1:
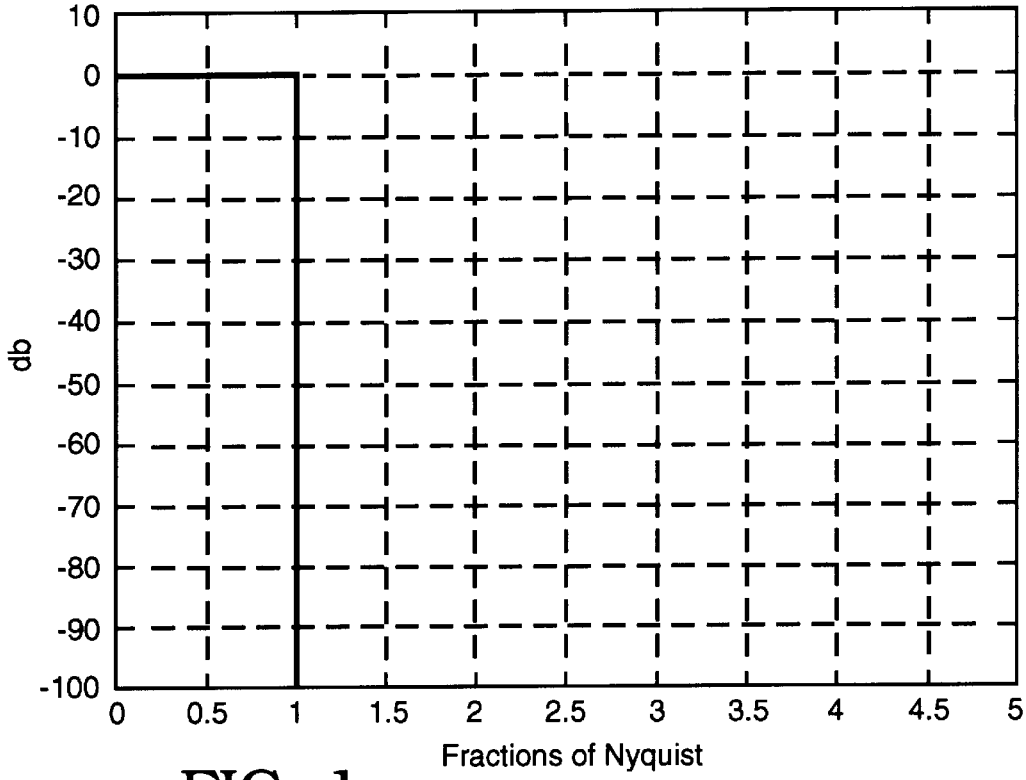
FIG. 1 shows an ideal "brick-wall" interpolation frequency response.
Figure 2:
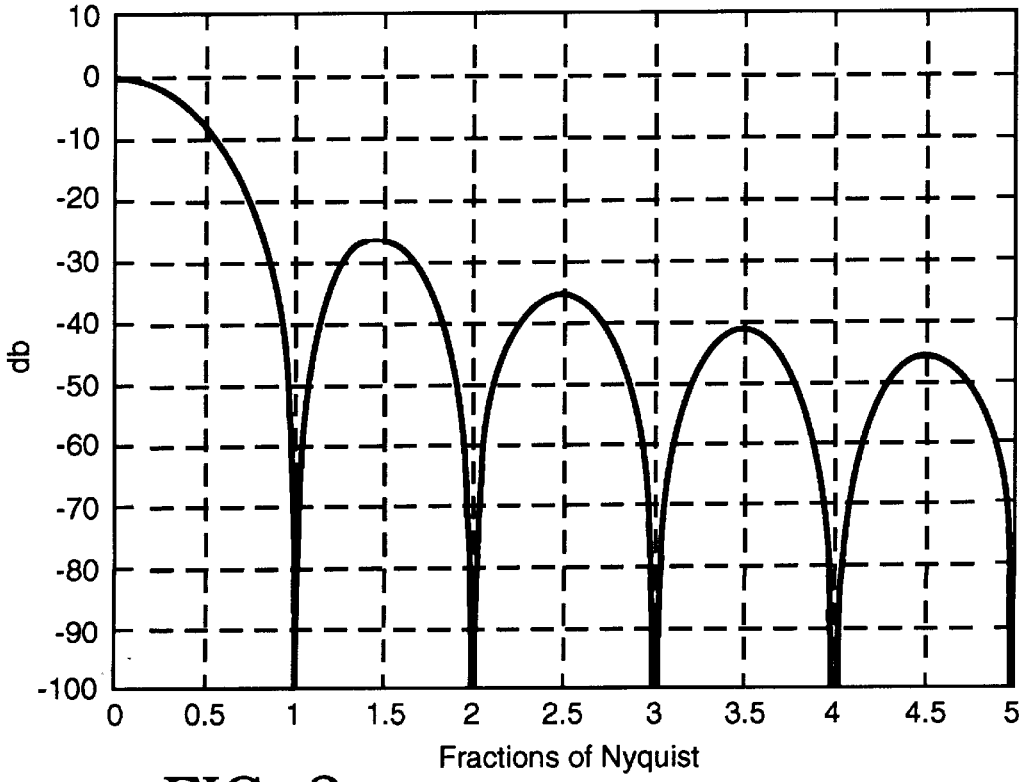
FIG. 2 shows a linear interpolation frequency response showing rolloff.
Figure 3:
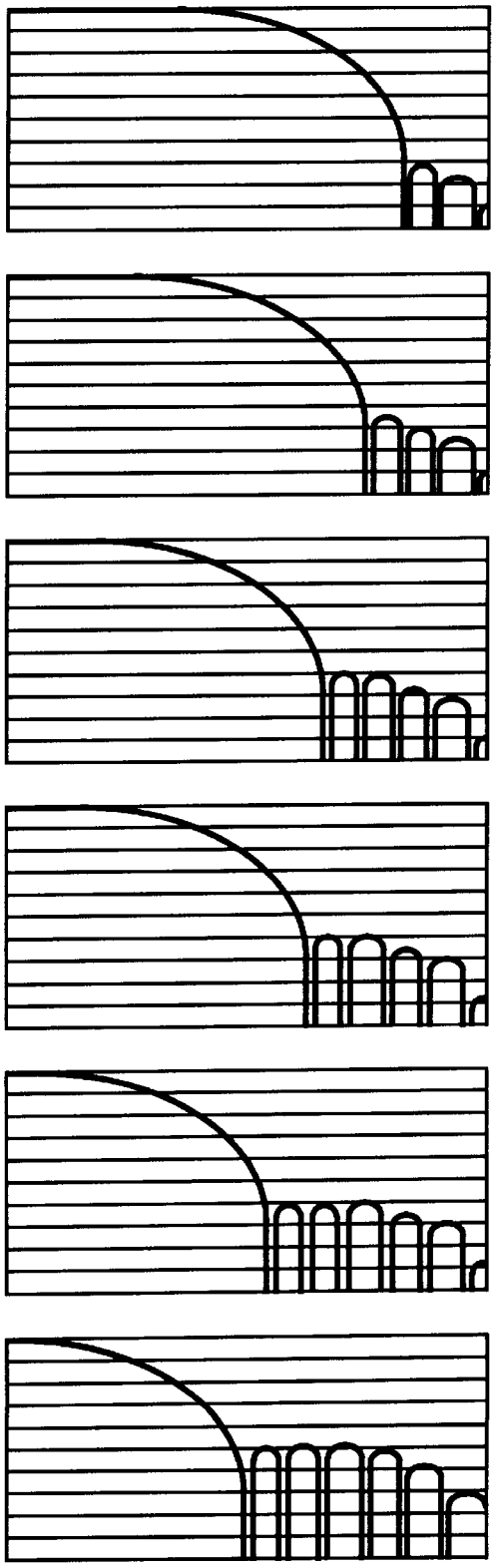
FIG. 3 shows an 8-point interpolation frequency response in the prior art.
Figure 4:
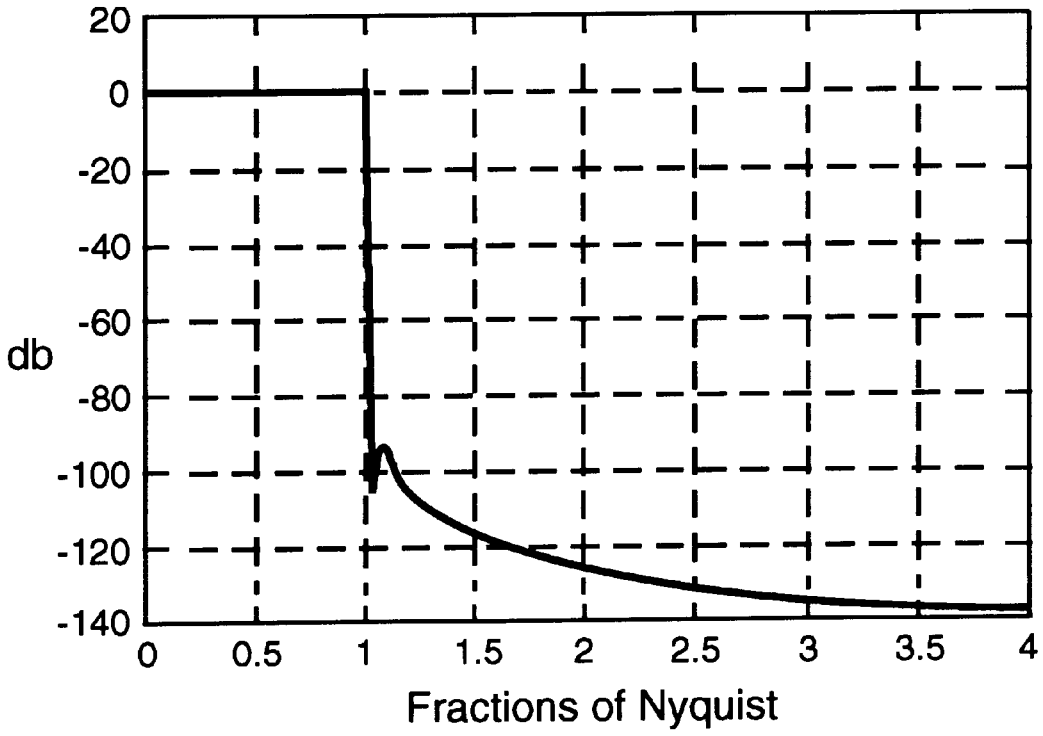
FIG. 4 shows a wavefunction model interpolation response in accordance with the invention.

The following discloses a new signal representation scheme having advantages over traditional PCM representations. Rather than being constrained by the tradeoff between low-quality, low-cost resampling versus high-quality, high-cost resampling it is possible to obtain high-quality, low-cost resampling. This scheme features locality and a more natural representation of an analog waveform than does PCM, lowering the cost of computation and eliminating the need for a polyphase reconstruction filter. The difficult interpolative computations are undertaken by "front-end" preprocessing, and the "back-end" tone-generating synthesis engine (processor) is thereby freed up in the encoding process. Nearly-perfect arbitrary-ratio resampling of stored waveforms can be effected in the back end at a fraction of the cost of traditional resampling. FIG. 4 shows a model filter frequency response typical of this wavefunction representation. In FIG. 4, the frequency response was derived with a small upsampling filter having 512 lobes of a sinc ( ) function, unsampled by 256 samples per lobe, using a Kaiser window with $\beta=8$.

Another advantage of this wavefunction approach is that since the waveform reconstruction information is fully contained within the polynomials, there is no need to use an unwieldy polyphase coefficient table. This is especially advantageous since music synthesis is finding increased applications in multimedia environments implemented on general-purpose commercially available multitasking media engines, such as processor MMX™-enabled Intel processors. In such environments, there is no dedicated ROM so any such coefficient tables would have to be swapped in and out of local caches during context switches between real-time processes, thus undesirably adding to overall system load.

As stated above, the present wavefunction approach for encoding operates in two stages. The first stage occurs (in one embodiment) "off-line" and entails the translation of a raw signal waveform into a segmented polynomial format. As with PCM representation, the signal to be encoded is appropriately bandlimited. The second stage occurs "on line" when the stored waveform is reconstructed (played back, also referred to as decoded). Ultimately, the output of the wavefunction encoding process is a PCM sample stream, which is possibly mixed in with other output streams if polyphonic output is being generated, and then, for the playback, sent to an output DAC (Digital to Analog Converter).

Signal Representations and Reconstruction

The following discloses how signals are reconstructed and represented in the present wavefunction approach.

Figure 5:
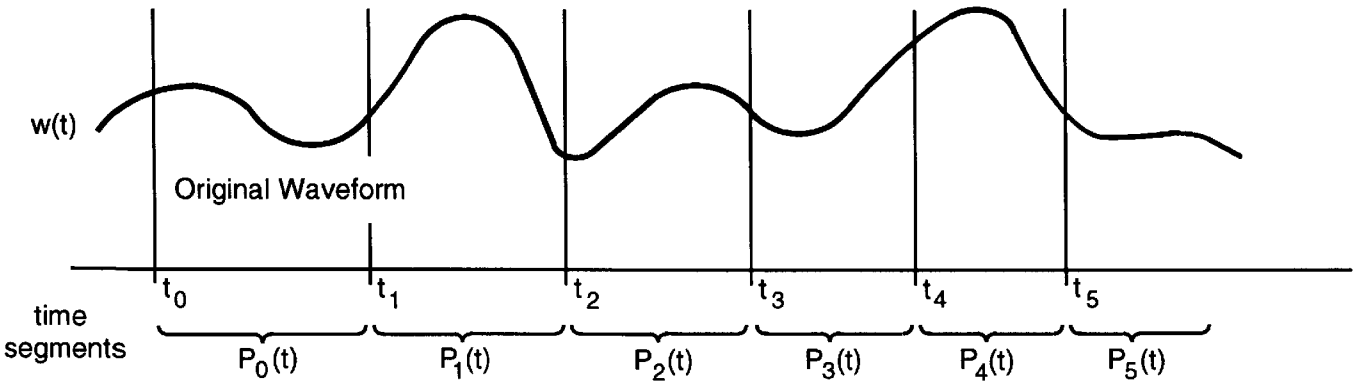
FIG. 5 shows graphically a waveform being encoded.

Simply put, in the wavefunction approach (See FIG. 5), the original analog signal is represented as an indexed array of polynomial segments $$w(t)[p_0, p_r: \ldots :p_{N-1}](t), \tag{4}$$

where the k-th polynomial is defined on the time interval $[\tau_k, \tau_{k+1}]$, the $\{\tau_k\}^N_{k=0}$ defining the time segment endpoints. In FIG. 5, time (t) is the horizontal axis and amplitude is the vertical axis. For convenience, assume that $t_0=0$. Since polynomials are continuous-time functions, a wavefunction-encoded waveform is represented naturally as a continuous-time function.

When an output sample is desired for time t, the index k(t) is first found such that $t\epsilon[\tau_{k(t)}, \tau_{k(t)+1}]$. Then, the output sample is computed as $$w(t)=p_{k(t)}(t). \tag{5}$$

As can be seen, the number of operations necessary to compute a single sample can be quite small. If p(t) is an M-th degree polynomial, it is simply M multiplies and M adds. One way to calculate a polynomial $$p(t)=a_0+a_1t+\ldots+a_Mt^M \tag{6}$$

is to apply Horner's rule, iterating as $$p_{[1]}(t)=t\cdot a_M+a_{M-1} \tag{7}$$

$$p_{[2]}(t)=t\cdot p_{[1]}(t)+a_{M-2} \tag{8}$$

$$\vdots \tag{9}$$

$$p_{[M]}(t)=t\cdot p_{[M-1]}(t)+a_0 \tag{10}$$

$$p(t)=p_{[M]}(t). \tag{11}$$

This has the advantage of avoiding the explicit calculation of powers of t. A typical application of wavefunction uses a third order polynomial for each segment, thus implying a potential computational savings of over 80% over 8-point resampling synthesis.

To generate the desired PCM output stream, a timebase generator generates a sequence of discrete time points $t_0, t_1, \ldots, t_n, \ldots$, in the encoded waveform's time coordinates. The PCM stream is directly attained by performing the calculation in Eqn. (5) for each time point for the playback. If the sample period of the output (playback) DAC is T, a faithful reproduction of the output stream is generated for the playback by using time points such that $t_n=nT$. Assume that the cutoff frequency $$f_c < \frac{1}{2T}, \tag{12}$$

to avoid aliasing artifacts. It should be noted that imaging artifacts do not occur with this signal representation scheme, unlike with PCM resampling.

If constant time warping for pitch shifting is desired, as for musical note transposition, an appropriate ratio r may be chosen so that $$t_n=nrT; \tag{13}$$

r<1 results in a down-shift in pitch, and r>1 results in an up-shift. In the general case of time-varying time/pitch warping, as when pitch bend control is provided, the resampling ratio is time-dependent and must be integrated, so that $$t_n = \int_0^{nT} r(t)\,dt, \tag{14}$$

or the discrete-time version:

$$t_n = T\sum_{i=0}^{n-1} r_i \tag{15}$$

$$= t_{n-1} + Tr_{n-1} \tag{16}$$

Sections

In the general case, the segment lengths $l_k=\tau_{k+1}-\tau_k$ are arbitrary. Additionally, the polynomials $p_k(t)$ may also have different degrees. An advantage of the general case is that one can better handle signals that are non-stationary. For example, a musical note recording may have a broadband transient at the attack and decay down to a low-bandwidth signal with defined harmonics. Such a signal would probably be better fitted using smaller segments during the attack phase and longer segments as the waveform settles down to a smoother tone.

A disadvantage of variable degrees and segment lengths is that these parameters must be specified in the data format for each segment. In many cases, however, it is convenient to partition the waveform into sections in which each section consists of segments having equal length and equal degree. This allows savings in overhead since it is easier to design algorithms and hardware that handle uniform cases, especially when working with parallel-processing hardware that allows the computation of several samples simultaneously.

Within a section, each segment is defined to have the same length, and all the polynomials can have the same degree. The header information for each section contains the length and degree information, among other things. To denote the use of sections, we augment our notation so that $N_s$ is the number of sections in the wavefunction-encoded waveform, the j-th section, $0\leqq j<N_s$, consists of $N_j$ segment polynomials $p_{j,k}(t)$, with $0\leqq j<N_s$, and the starting time of the k-th segment is $$t_{j,k}=t_{j,0}+k\cdot l_j, \tag{17}$$

where $l_j$ is the per-segment length within the j-th section. To induct on j we have furthermore, $$t_{j+1,0}=t_{j,0}+N_j\cdot l_j, \tag{18}$$

and $\tau_{0,0}=0$, for convenience.

Polynomial Format

The polynomial selected, $p_{j,k}(t)$ is defined over the interval $[\tau_{j,k}, \tau_{j,k+1}]$. However, this does not mean that the actual polynomial implementation must be set up to be evaluated on this range. For numerical reasons, it is advantageous to recast the implementation so that the polynomial evaluated over the range [−1, 1] since this normalization generally keeps the coefficient size down. The relation $$\tilde{p}_{j,k}(\tau) \triangleq p_{j,k}\left(\tau_{j,k} + \frac{l_j(\tau+1)}{2}\right) \tag{19}$$

accomplishes the desired mapping.

There are further refinements in how the polynomials can be represented. Two versions of the wavefunction algorithm are disclosed here: the Independent Polynomial Segments (IPS), and the Cubic Spline Segment (CSS). (Others, of course, are also available.) The two versions share many characteristics but differ in how information is shared between segments. IPS is computationally faster than CSS, but requires about twice as much storage space (memory) as CSS.

Independent Polynomial Segments: (IPS) is a direct implementation of $\tilde{p}_{j,k}(t)$ defined over the interval [−1, 1], specifying a vector of coefficients $$C_{j,k} \triangleq \begin{bmatrix} c_{j,k}^{(0)} \\ \vdots \\ c_{j,k}^{(M_j)} \end{bmatrix} \tag{20}$$

so that $$\tilde{p}_{j,k}(\tau) = \sum_{i=0}^{M_j} c_{j,k}^{(i)}\tau^i \tag{21}$$

For $M_j=3$, this takes only 3 multiplies and 3 adds, using Horner's rule.

The IPS representation is fast, but has the disadvantage of requiring about twice as much storage space as the Cubic Spline Segments (CSS) representation. In a general $S_j$-th order spline implementation, the endpoints, also known as knot points, of each segment are attributed with a vector $$Q_{j,k} \triangleq \begin{bmatrix} q_{j,k}^{(0)} \\ \vdots \\ q_{j,k}^{(S_{j-1})} \end{bmatrix} \tag{22}$$

denoting the values of the derivatives or equivalent information. The k-th polynomial $\tilde{p}_{j,k}(\tau)$ is thus specified by $Q_{j,k}$ and $Q_{j,k+1}$. To derive the relationship between the knot points and $C_{j,k}$, start by noting that $$M_j=2S_j-1. \tag{23}$$

Define $$d(n,k) \triangleq \begin{cases} \dfrac{n!}{(n-k)!} & \text{if } 0 \le k \le n \\ 0, & \text{otherwise} \end{cases} \tag{24}$$

The derivatives are then $$\tilde{p}_{j,k}^{(m)}(\tau) = \sum_{i=m}^{2S_j-1} d(i,m)c_{j,k}^{(i)}\tau^{i-m} \tag{25}$$

and must equal the corresponding knot values at the endpoints. Thus, for the left endpoints at $$\sum_{i=m}^{2S_j-1} d(i,m)c_{j,k}^{(i)}(-1)^{i-m} = q_{j,k}^{(m)} \tag{26}$$

and for the right endpoints, $$\sum_{i=m}^{2S_j-1} d(i,m)c_{j,k}^{(i)} = q_{j,k+1}^{(m)}. \tag{27}$$

Define $$d^-(n,k)=(-1)^{(nk)}d(n,k) \tag{28}$$

so that $$D_j^- = \begin{bmatrix} d^-(0,0) & d^-(1,0) & \cdots & d^-(2S_j-1,0) \\ d^-(0,1) & d^-(1,1) & \cdots & d^-(2S_j-1,1) \\ \vdots & & & \vdots \\ d^-(0,S_j-1) & & \cdots & d^-(2S_j-1,S_j-1) \end{bmatrix} \tag{29}$$

$$D_j^+ = \begin{bmatrix} d(0,0) & d(1,0) & \ldots & d(2S_j-1,0) \\ d(0,1) & d(1,1) & \ldots & d(2S_j-1,1) \\ \vdots & & & \vdots \\ d(0,S_j-1) & & \ldots & d(2S_j-1,S_j-1) \end{bmatrix} \tag{30}$$

and $$D = \begin{bmatrix} D_j^- \\ D_j^+ \end{bmatrix} \tag{31}$$

Then, in matrix form, Eqns. (26, 27) become $$\begin{bmatrix} Q_{j,k} \\ Q_{j,k+1} \end{bmatrix} = DC_{j,k} \tag{32}$$

Solving for $C_{j,k}$, $$C_{j,k} = D^{-1}\begin{bmatrix} Q_{j,k} \\ Q_{j,k+1} \end{bmatrix}. \tag{33}$$

For the case S2, we have $$D = \begin{bmatrix} 1 & -1 & 1 & -1 \\ 0 & 1 & -2 & 3 \\ 1 & 1 & 1 & 1 \\ 0 & 1 & 2 & 3 \end{bmatrix} \tag{34}$$

so that $$D^{-1} = \frac{1}{4}\begin{bmatrix} 2 & 1 & 2 & -1 \\ -3 & -1 & 3 & -1 \\ 0 & -1 & 0 & 1 \\ 1 & 1 & -1 & 1 \end{bmatrix} \tag{35}$$

This matrix can be "thinned out" by noticing the butterfly relationship between columns 1,3 and 2,4. This is instantiated by the matrix $$B = \begin{bmatrix} 1 & 0 & 1 & 0 \\ 0 & 1 & 0 & 1 \\ 1 & 0 & -1 & 0 \\ 0 & 1 & 0 & -1 \end{bmatrix}. \tag{36}$$

Then Eqn. (33) becomes $$C_{j,k} = (D^{-1}B^{-1})B\begin{bmatrix} Q_{j,k} \\ Q_{j,k+1} \end{bmatrix}, \tag{37}$$

with $$D^{-1}B^{-1} = \frac{1}{4}\begin{bmatrix} 2 & 0 & 0 & 1 \\ 0 & -1 & -3 & 0 \\ 0 & 0 & 0 & -1 \\ 0 & 1 & 1 & 0 \end{bmatrix} \tag{38}$$

thus reducing the number of multiplies. The resulting number of computations is thus:

4 adds for the butterfly operations incurred by B;

about 2 multiplies and 3 adds to implement $D^{-1}B^{-1}$, with 4 possible scaling operations (by ¼);

and 3 multiplies and 3 adds to calculate the polynomial $\tilde{p}_{j,k}(t)$ thus generated, using Horner's rule, for a total of about 10 adds and 5 multiplies. This is still a savings of about a factor of 2 to 3 over 8-point interpolated polyphase resampling.

Time Indexing

If operating in the j-th section, it is easy to determine the particular polynomial $\tilde{p}_{j,k}(t)$. If the current time is $t_n$, calculate the segment index $$k = \left\lfloor \frac{t_n - \tau_{j,0}}{l_j} \right\rfloor. \tag{39}$$

Time is assumed to start at $t_0=0$ and the initial segment is j=0. Before each sample computation is started, the current time $t_n$ is checked against the end of the current segment; if $t_n>\tau_j, N_j$, the segment index j is incremented until $\tau_n\epsilon[\tau_{j,0}, \tau_J, N_J]$. If $T_N>\tau_{N_s}, N_{N_s}$ i.e. $T_N$ is beyond the end of the last segment, the note is considered to have terminated, unless a looping structure is being used, in which case it loops back to some previous segment.

Upon entering a segment, set $$\theta = \frac{t_n - \tau_{j,0}}{l_j}. \tag{40}$$

One can now easily read off the segment index, as well as the argument of the polynomial:

$$\theta=k+f, \tag{41}$$

where $k=\lfloor\theta\rfloor$ is the integer part, and $f=\theta-k$is the fractional part. The desired value of the waveform is thus $$w(t_n)=\tilde{p}_{j,k}(2f-1). \tag{42}$$

To compute the next sample, time is updated as $$t_{n+1}=t_n+Tr_n. \tag{43}$$

The segment endpoint condition $t_{n+1}<t_{j,Nj}$ is checked with the appropriate exception conditions taken. If we are in the same segment as before, then θ is updated as $$\theta := \theta + \frac{Tr_n}{l_j} \tag{44}$$

which is especially convenient if $r_n$ is constant. Otherwise, if the segment has incremented, Eqn. (40) is used to calculate the new θ.

Thus, a sequence of points $t_0, \ldots, t_n$, is generated, with possibly time-varying ratio $r_n$ taken into account. Section and segment position are tracked; the appropriate polynomial is selected and evaluated with the time argument, thereby regenerating the waveform w(t) at the desired times.

Polynomial Fitting Methods

The above describes how to do the back-end calculation s for reconstructing a signal from a wavefunction representation. Hereinafter is described how to do the front-end transformation of a raw input signal into a segmented wavefunction representation.

Figure 6:
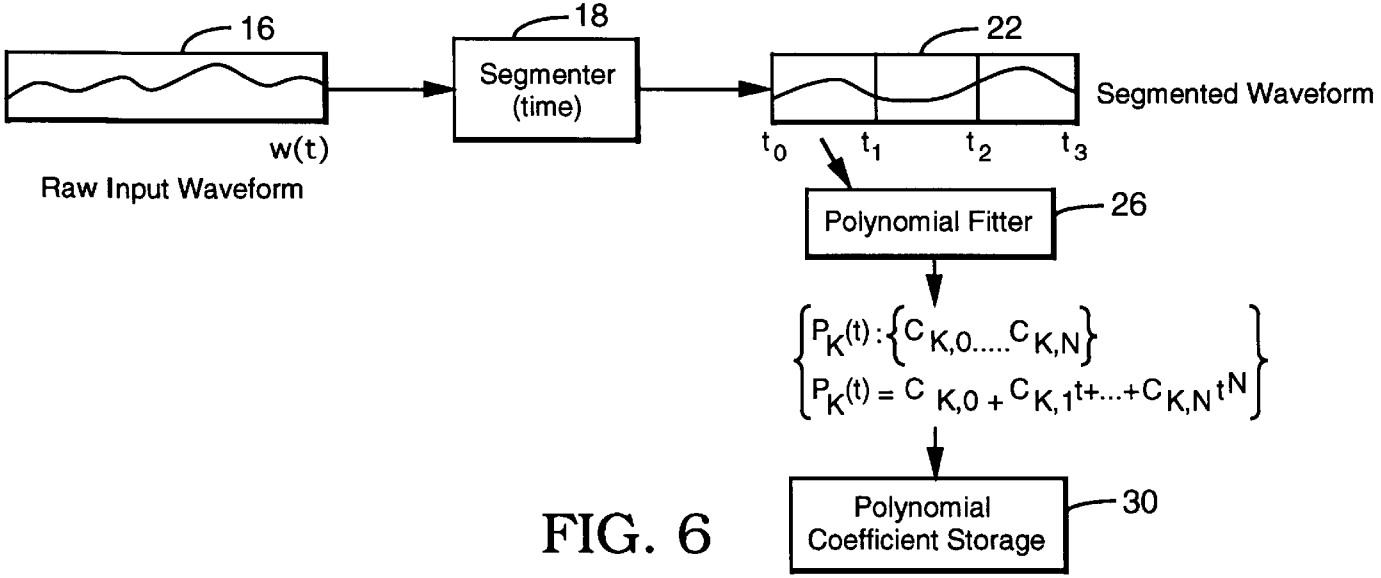
FIG. 6 shows an apparatus for encoding using polynomials.

This front-end transformation (for the IPS format) is performed by an apparatus as shown in FIG. 6. To start with, at 16 in FIG. 6, the raw input waveform w(t) (see FIG. 5) is assumed to be continuous-time. Usually, however, this raw waveform is provided as a PCM signal p[n], sampled at frequency $f_s$. In this case, an approximation to a continuous in time signal may be effected by upsampling by a large factor. Using the known guideline of using $\sqrt{2^N}$ phases in linearly interpolated polyphase resampling, if 16 bits of accuracy are desired, then at least 256 phases are needed. Thus upsampling by a factor of 256 and then linearly interpolating should do a reasonable job of approximating the desired continuous-time function. Since the resampling action can be generally be done off-line, an arbitrary amount of computation can be used to perform the upsampling. Hence, very long windowed sinc functions with many zero-crossings may be used; 256 to 512 lobes are reasonable.

In order to proceed with the fitting, the segment lengths $l_j=\tau_{j,k+1}-\tau_{j,k}$ must be determined, as well as the section boundaries, if any. Section boundaries are chosen to partition the waveform into regions with significantly different statistics. A useful statistic is the spectrogram since, as shown above, the error power is proportional to the (M+1)-th power of the frequency. The primary reason for partitioning a waveform into sections is to allow segments of similar statistics to share segment lengths $l_j$, since it is the (M+1)-th power of the time-bandwidth product $l_jf_c$ which bounds the polynomial approximation error. This allows better fits within each section, saving memory bandwidth, for example, when a musical note evolves from a broadband attack to a steady-state tone.

To find the segment length at 18 generally an error criterion is provided, and a segment length is arrived at that meets or exceeds the criterion. When fitting over a section, an error criterion is chosen to measure the error over the whole section. Such metrics as $L_\infty$ (maximum error), or $L_2$ are typical possibilities to use. There are a variety of techniques that could be used, including iterative fitting methods, in which different lengths are used to segment each section until the objective error metric satisfies the given constraints. Sub-band fitting is discussed below:

After a candidate length $\tilde{l}_j$ is chosen for a section, the number of segments $N_j$ is determined at 18 by simply dividing through and rounding up:

$$N_j = \frac{SectionLength}{\tilde{l}_j} \tag{54}$$

and the final segment length is determined as $$\tilde{l}_j = \frac{SectionLength}{N_j} \tag{55}$$

Once the section has been segmented at 22 to provide a segmented waveform at 26, the polynomials $p_{j,k}(t)$ may be fitted to the target function x(t) over their respective intervals $[\tau_{j,k}, \tau_{j,k+1}]$, for $0 \leqq k < N_j$.

Independent Polynomial Segment (IPS) Technique

Hereinafter is disclosed how to encode raw PCM waveforms into the IPS format using the polynomial fitter 26 of FIG. 6. The goal is to fit a raw polynomial $p_k(t)$ of the form $$\tilde{p}_k(\tau) = \sum_{i=0}^{M} c_k^{(i)} \tau^i \tag{56}$$

on the interval $\tau \epsilon [-1,1]$ to a function x(t) defined on the interval $\tau \epsilon [\tau_k, \tau_{k+1}]$. (The section index j is dropped here for convenience). Define $$\tilde{x}_k(\tau) = x\left(\frac{(\tau+1)(\tau_{k+1}-\tau_k)}{2} + \tau_k\right), \tag{57}$$

so that one may fit over the interval $\tau \epsilon [-1,1]$.

Fitting to a raw polynomial requires more care than using a spline. Since the segments are independent, significant discontinuities could arise. If there is a tolerance for error $$|\tilde{p}_k(\tau)-\tilde{x}_k(\tau)|<\epsilon \tag{58}$$

then it is possible for a discontinuity of 2ϵ to arise at an endpoint if the left and right limits have different sign errors.

In general, to do a fit over an interval, one must minimize an error metric. The $L_p$ metric, defined for $1 \leqq p$, metric over the interval is given as $$\|\tilde{p}_k(\tau) - \tilde{x}_k(\tau)\|_p = \left\{\int_{-1}^{1} |\tilde{p}_k(\tau) - \tilde{x}_k(\tau)|^p d\tau\right\}^{\frac{1}{p}} \tag{59}$$

Minimizing this is the same as minimizing $$\epsilon^p = \int_{-1}^{1} |p_k(\tau)-x_k(\tau)|^p d\tau \tag{60}$$

Sometimes it is useful to introduce a weighting function $u(\tau) \geqq 0$ to modify the metric, so one wishes to minimize $$\epsilon^p = -_{1-1}|\tilde{p}_k(\tau)-\tilde{x}_k(\tau)|^p u(\tau) d\tau \tag{61}$$

Taking the gradient of Eqn. (61) with respect to each polynomial coefficient, with p=2 yields $$\frac{\partial \varepsilon^2}{\partial c_k^{(n)}} = 2\int_{-1}^{1} (\tilde{p}_k(\tau) - \tilde{x}_k(\tau))\tau^n u(\tau) d\tau \tag{61}$$

The $L_2$ metric with $u(\tau)=1$ is especially useful because of the ease of analysis. To obtain the least-squares fit, we set this to zero for n=0, . . . , M. Thus, $$\xi_k^{(n)} \triangleq \int_{-1}^{1} x_k(\tau)\tau^n d\tau \tag{63}$$

$$= \int_{-1}^{1} \tilde{p}_k(\tau)\tau^n d\tau \tag{64}$$

$$= \sum_{m=0}^{M} c_k^{(m)} \int_{-1}^{1} \tau^{n+m} d\tau \tag{65}$$

$$= \sum_{m=0}^{M} c_k^{(m)} \frac{1+(-1)^{n+m}}{n+m+1} \tag{66}$$

In matrix form, $$\begin{bmatrix} c_k^{(0)} \\ \vdots \\ c_k^{(M)} \end{bmatrix} = P^{-1} \begin{bmatrix} x_k^{(0)} \\ \vdots \\ x_k^{(M)} \end{bmatrix}, \tag{67}$$

where the (j, k)-th element of P is $$P_{j,k} = \frac{1+(-1)^{n+m}}{n+m+1}, \tag{68}$$

indexing from (0, 0). For M=3, we have $$P = \begin{bmatrix} \frac{2}{1} & 0 & \frac{2}{3} & 0 \\ 0 & \frac{2}{3} & 0 & \frac{2}{5} \\ \frac{2}{3} & 0 & \frac{2}{5} & 0 \\ 0 & \frac{2}{5} & 0 & \frac{2}{7} \end{bmatrix} \tag{69}$$

and $$P^{-1} = \frac{1}{8}\begin{bmatrix} 9 & 0 & -15 & 0 \\ 0 & 75 & 0 & -105 \\ -15 & 0 & 45 & 0 \\ 0 & -105 & 0 & 175 \end{bmatrix} \tag{70}$$

The coefficients generated using Eqn. (67) result in the least-mean-square error fit over the interval [−1, 1]. However, such a fit is known to have poor absolute error, especially near the endpoints. A better fit for the endpoints uses a weighted measure with $$u(\tau) = \frac{1}{\sqrt{1-\tau^2}} \tag{71}$$

This norm yields a projection onto a sine series as illustrated with the substitution $\tau=\sin\theta$ in Eqn.

$$\frac{\partial \varepsilon^2}{\partial c_k^{(n)}} = 2\int_{-1}^{1} (p_k(\tau) - x_k(\tau))\tau^n \frac{d\tau}{\sqrt{1-\tau^2}} \tag{72}$$

$$= 2\int_{-\pi/2}^{\pi/2} (p_k(\sin\theta) - \tilde{x}_k(\sin\theta)\sin^n\theta d\theta. \tag{73}$$

Then $$\zeta_k^{(n)} \triangleq \int_{-1}^{1} \tilde{x}_k(\tau)\tau^n \frac{d\tau}{\sqrt{1-\tau^2}} \tag{74}$$

$$= \int_{-\pi/2}^{\pi/2} \tilde{x}_k(\sin\theta)\sin^n\theta d\theta \tag{75}$$

$$= \int_{-\pi/2}^{\pi/2} p_k(\sin\theta)\sin^n\theta d\theta \tag{76}$$

$$= \sum_{m=0}^{M} c_k^{(m)} \int_{-\pi/2}^{\pi/2} \sin^{n+m}\theta d\theta \tag{77}$$

$$= \sum_{m=0}^{M} c_k^{(m)} \sigma(m+n) \tag{78}$$

where $$\sigma(k) = \begin{cases} 0 & \text{if } k \text{ is odd,} \\ \frac{k!\pi}{2^k (k/2)!^2} & \text{if } k \text{ is even.} \end{cases} \tag{79}$$

In matrix form, $$\begin{bmatrix} c_k^{(0)} \\ \vdots \\ c_k^{(M)} \end{bmatrix} = R^{-1} \begin{bmatrix} \zeta_k^{(0)} \\ \vdots \\ \zeta_k^{(M)} \end{bmatrix}, \tag{80}$$

where $$R_{j,k} = \sigma(j+k), \tag{81}$$

indexing from (0, 0). For M=3, one has $$R = \pi \begin{bmatrix} \frac{1}{1} & 0 & \frac{1}{2} & 0 \\ 0 & \frac{1}{2} & 0 & \frac{3\cdot 1}{4\cdot 2} \\ \frac{1}{2} & 0 & \frac{3\cdot 1}{4\cdot 2} & 0 \\ 0 & \frac{3\cdot 1}{4\cdot 2} & 0 & \frac{5\cdot 3\cdot 1}{6\cdot 4\cdot 2} \end{bmatrix} \tag{82}$$

and $$R^{-1} = \frac{1}{\pi}\begin{bmatrix} 3 & 0 & -4 & 0 \\ 0 & 20 & 0 & -24 \\ -4 & 0 & 8 & 0 \\ 0 & -24 & 0 & 32 \end{bmatrix} \tag{83}$$

All that remains is to perform the integrals in Eqns. (63) or (74) giving rise to $\xi_k^{(n)}$ or, depending on if Eqn. (67) or Eqn. (80), respectively, is used to perform the approximation. Techniques for performing such integrations are well-known in the art; see for example, *Numerical Recipes in C,* W. H. Press et al, Cambridge University Press, 1992, incorporated by reference herein.

Once the coefficients for the k-th segment are determined at 26 in FIG. 6, they are stored in a memory (polynomial coefficient storage) 30 for retrieval, indexed by segment number k.

Cubic Spline Segment (CSS) Technique

Figure 7:
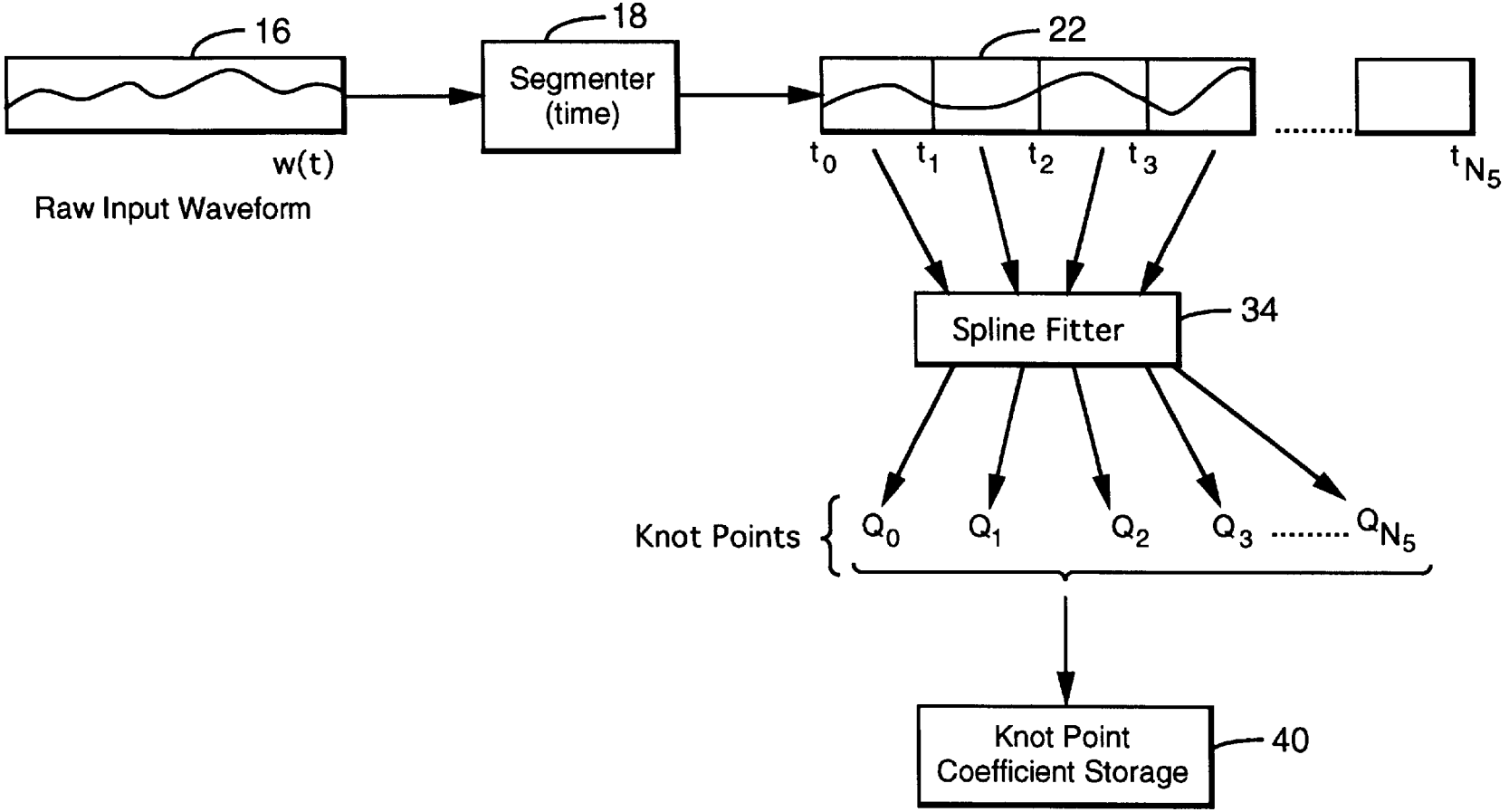
FIG. 7 shows an apparatus for encoding using splines.

The CSS encoding apparatus is shown in FIG. 7. Elements 16, 18, 22 as the same as for the IPS encoding apparatus of FIG. 6. In the CSS version of wavefunction, knot points are estimated for the spline fitter 34. Since knot points are shared between adjacent segments for the spline fitter 34, except for the first or last knot point in a section, it is best to fit each knot point over several neighboring segments. Conventional spline-fitting algorithms generally fit knot points by matching the endpoint values and derivatives but ignore the values of the target function in between the knot points. The following technique fits over the entire interval, rather than just at the knot points. This uses an Lp metric, as above. The error is $$\varepsilon = \left\{ \sum_{k=0}^{N-1} \int_{-1}^{1} [\tilde{x}_k(\tau) - \tilde{p}_k(\tau)]^p u_k(\tau) d\tau \right\}^{\frac{1}{p}} \tag{84}$$

where $\tilde{p}_k(\tau)$ is determined from the knot points $Q_k$ and $Q_{k+1}$, using Eqn. (33), and $u_k(\tau)$ is an optional weighting function over the k-th segment. For simplicity assume that p=2. To minimize the squared error, $$\frac{d\varepsilon^2}{dq_k^{(l)}} = \frac{\partial \varepsilon^2}{\partial c_{k-1}^{(0)}} \frac{\partial c_{k-1}^{(0)}}{\partial q_k^{(l)}} + \cdots + \frac{\partial \varepsilon^2}{\partial c_{k-1}^{(2S-1)}} \frac{\partial c_{k-1}^{(2S-1)}}{\partial q_k^{(l)}} + \frac{\partial \varepsilon^2}{\partial c_{k-1}^{(0)}} \frac{\partial c_k^{(0)}}{\partial q_k^{(l)}} + \cdots + \frac{\partial \varepsilon^2}{\partial c_k^{(2S-1)}} \frac{\partial c_{k-1}^{(2S-1)}}{\partial q_k^{(l)}} = 0 \tag{85}$$

for k=0, . . . , N, and l=0, . . . , S−1, with the understanding that derivatives with respect to $c_{-1}^{(m)}$ and $c_N^{(m)}$ are zero. The derivative terms are simply the elements of $D^{-1}$.

$$\frac{\partial c_k^{(m)}}{\partial q_k^{(l)}} = [D^{-1}]_{m,l} \text{ and} \tag{86}$$

$$\frac{\partial c_{k-1}^{(m)}}{\partial q_k^{(l)}} = [D^{-1}]_{m,l+S} \tag{87}$$

Recall that $$\frac{\partial \varepsilon^2}{\partial c_k^{(m)}} = \int_{-1}^{1} [\tilde{p}_k(\tau) - \tilde{x}_k(\tau)] \tau^m u^k(\tau) d\tau \tag{88}$$

$$= \int_{-1}^{1} \tau^m \left\{ [1\tau \cdots \tau^{2S-1}] \begin{bmatrix} c_k^{(0)} \\ \vdots \\ c_k^{(2S-1)} \end{bmatrix} - \tilde{x}_k(\tau) \right\} u_k(\tau) d\tau \tag{89}$$

-continued $$= \int_{-1}^{1} \tau^m \left\{ [1\tau \cdots \tau^{2S-1}] D^{-1} \begin{bmatrix} Q_k \\ Q_{k+1} \end{bmatrix} - \tilde{x}_k(\tau) \right\} u_k(\tau) d\tau, \tag{90}$$

for k=0, . . . , N−1. In gradient form, $$\nabla C_k \varepsilon^2 = \int_{-1}^{1} \begin{bmatrix} 1 \\ \tau \\ \vdots \\ \tau^{2S-1} \end{bmatrix} \left\{ [1\tau \cdots \tau^{2S-1}] D^{-1} \begin{bmatrix} Q_k \\ Q_{k+1} \end{bmatrix} - \tilde{x}_k(\tau) \right\} u_k(\tau) d\tau \tag{91}$$

$$= \int_{-1}^{1} \begin{bmatrix} 1 \\ \tau \\ \vdots \\ \tau^{2S-1} \end{bmatrix} [1\tau \cdots \tau^{2S-1}] u_k d\tau D^{-1} \begin{bmatrix} Q_k \\ Q_{k+1} \end{bmatrix} - \int_{-1}^{1} \begin{bmatrix} 1 \\ \tau \\ \vdots \\ \tau^{2S-1} \end{bmatrix} \tilde{x}_k(\tau) u_k(\tau) d\tau \tag{92}$$

$$= T_k D^{-1} \begin{bmatrix} Q_k \\ Q_{k+1} \end{bmatrix} - \Gamma_k, \tag{93}$$

where $$T_k \triangleq \int_{-1}^{1} \begin{bmatrix} 1 \\ \tau \\ \vdots \\ \tau^{2S-1} \end{bmatrix} [1\tau \cdots \tau^{2S-1}] u_k(\tau) d\tau \tag{94}$$

and $$\Gamma_k \triangleq \int_{-1}^{1} \begin{bmatrix} 1 \\ \tau \\ \vdots \\ \tau^{2S-1} \end{bmatrix} \tilde{x}_k(\tau) u_k(\tau) d\tau. \tag{95}$$

Taking $T_k$=0 and $\Gamma_k$=0 for k=−1 and k=N, Eqn. (85) can be written as $$\nabla_{Q_k} \epsilon^2 = [O_S I_S] D^{-T} \nabla_{C_{k-1}} \epsilon^2 + [I_S O_S] D^{-T} \nabla_{C_k} \epsilon^2. \tag{96}$$

where $I_S$ and $O_S$ are the S×S identity and zero matrices, respectively. Define $$\Theta_k \triangleq D^{-T} T_k D^{-1} \text{ and} \tag{97}$$

$$\Phi_k \triangleq D^{-T} \Gamma_k \tag{98}$$

Note that the $\Theta_k$ are different only if $u_k(\tau)$ varies with k. Break up $\Theta_k$ into four S×S pieces:

$$\begin{bmatrix} \Theta_k^{[0]} & \Theta_k^{[1]} \\ \Theta_k^{[2]} & \Theta_k^{[3]} \end{bmatrix} \triangleq \Theta_k, \tag{99}$$

and $\Phi_k$ into two S×1 pieces:

$$\begin{bmatrix} \Phi_k^{[0]} \\ \Phi_k^{[1]} \end{bmatrix} \triangleq \Phi_k, \tag{100}$$

Setting $\nabla_{Q_k}\epsilon^2=0$, has $$[\Theta_{k-1}^{[2]}\Theta_{k-1}^{[3]}]\begin{bmatrix} Q_{k-1} \\ Q_k \end{bmatrix} + [\Theta_k^{[0]}\Theta_k^{[1]}]\begin{bmatrix} Q_k \\ Q_{K+1} \end{bmatrix} = \Phi_{k-1}^{[1]} + \Phi_k^{[0]}. \tag{101}$$

Define $$V \triangleq \begin{bmatrix} I_s & 0 & \cdots & & & & 0 \\ 0 & I_s & I_s & 0 & \cdots & & \\ 0 & 0 & 0 & I_s & I_s & \cdots & \vdots \\ \vdots & & & & & \ddots & \\ 0 & 0 & 0 & & & I_s\ I_s & 0 \\ 0 & 0 & \cdots & & & \cdots\ 0 & I_s \end{bmatrix} \tag{102}$$

Combining Eqns. (101) for k=0, . . . , N. one arrives at $$V\begin{bmatrix} \Theta_0 & 0 & \cdots & 0 \\ 0 & \Theta_1 & 0 & \\ \vdots & \ddots & & \vdots \\ 0 & \cdots & 0 & \Theta_{N-1} \end{bmatrix} V^T \begin{bmatrix} Q_0 \\ \vdots \\ \Theta_{N-1} \end{bmatrix} = V\begin{bmatrix} \Phi_0 \\ \vdots \\ \Phi_{N-1} \end{bmatrix}. \tag{103}$$

This can be solved for the knot points:

$$\begin{bmatrix} Q_0 \\ \vdots \\ Q_N \end{bmatrix} = \left( V\begin{bmatrix} \Theta_0 & 0 & \cdots & 0 \\ 0 & \Theta_1 & 0 & \\ \vdots & & \ddots & \vdots \\ 0 & \cdots & 0 & \Theta_{N-1} \end{bmatrix} V^T \right)^{-1} V\begin{bmatrix} \Phi_0 \\ \vdots \\ \Phi_{N-1} \end{bmatrix} \tag{104}$$

$$= \left( V\begin{bmatrix} \Theta_0 & 0 & \cdots & 0 \\ 0 & \Theta_1 & 0 & \\ \vdots & & \ddots & \vdots \\ 0 & \cdots & 0 & \Theta_{N-1} \end{bmatrix} V^T \right)^{-1} V\begin{bmatrix} D^{-T} & 0 & \cdots & 0 \\ 0 & D^{-T} & 0 & \\ \vdots & & \ddots & \vdots \\ 0 & \cdots & 0 & D^{-T} \end{bmatrix} \begin{bmatrix} \Gamma 0 \\ \vdots \\ \Gamma_{N-1} \end{bmatrix} \tag{105}$$

The latter equation allows direct utilization of the integral in Eqn. (95). Note that the projection matrix $$\Omega \triangleq \left( V\begin{bmatrix} \Theta_0 & 0 & \cdots & 0 \\ 0 & \Theta_1 & 0 & \\ \vdots & & \ddots & \vdots \\ 0 & \cdots & 0 & \Theta_{N-1} \end{bmatrix} V^T \right)^{-1} V\begin{bmatrix} D^{-T} & 0 & \cdots & 0 \\ 0 & D^{-T} & 0 & \\ \vdots & & \ddots & \vdots \\ 0 & \cdots & 0 & D^{-T} \end{bmatrix} \tag{106}$$

is a constant and only needs to be computed once for a particular set of weighting functions $u_0(\tau)$, . . . , $u_{N-1}(\tau)$. Empirically, the windowing functions $$u_k(\tau) = \frac{1}{\sqrt{1-\left(\frac{\tau+2k-N+1}{N}\right)^2}} \tag{107}$$

seem to work well. For simplicity, the windowing functions could be made the same giving alternatively $$u_k(\tau) = \frac{1}{\sqrt{1-\tau^2}}, \tag{108}$$

for all k. The error distribution in this case is slightly less uniform than the former case. The alternative $u_k(\tau)=1$ is simplest, but does poorly at the endpoints.

After the coefficients for each segment have been generated, they are stored in memory (knot point coefficient storage) 40 in FIG. 7 for use in waveform reconstruction.

Playback

Playback of the above encoded signals is accomplished as disclosed hereinafter. First, playback of the IPS encoded signals is depicted graphically in FIG. 8*a*. Again, the horizontal axis is time and the vertical axis is signal amplitude. The sample time segments $t_0$, . . . , $t_5$ are shown along the top. Of course, this is only a small portion of the relevant time. Immediately below are shown several segments, which are sequential segments labeled 0, 1, 2, 3. The segments in turn have various offsets $f_0$, $f_1$, $f_2$ relative to the sample time segment. This results in values expressed as 0, $f_0$, etc., which indicates the segment index and the segment offset from the sample time.

These offsets are used to reconstruct the signal, in this case the polynomial signal, as shown immediately below where at $t_0$ the waveform $w(t_0)=P_0(f_0)$ where $P_i$ refers to the polynomial. This represents the digital waveform. This is easily, then, for purpose of playback converted into an analog waveform by a digital to analog converter. See bottom portion of FIG. 8*a* showing the reconstructed PCM waveform as a smooth analog signal.

Figure 8A:
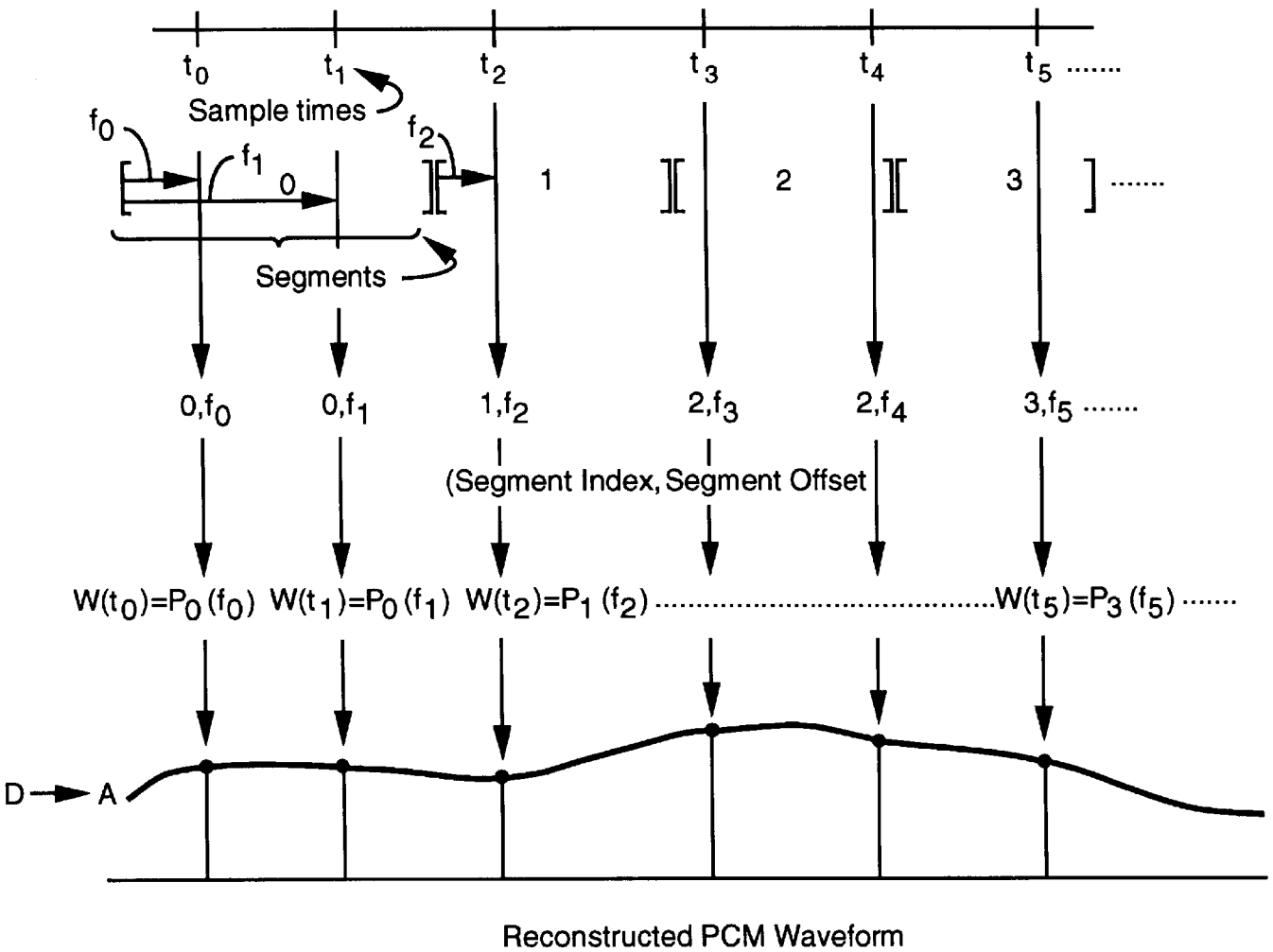
FIG. 8*a* shows graphically playback of a polynomial encoded signal.
Figure 8B:
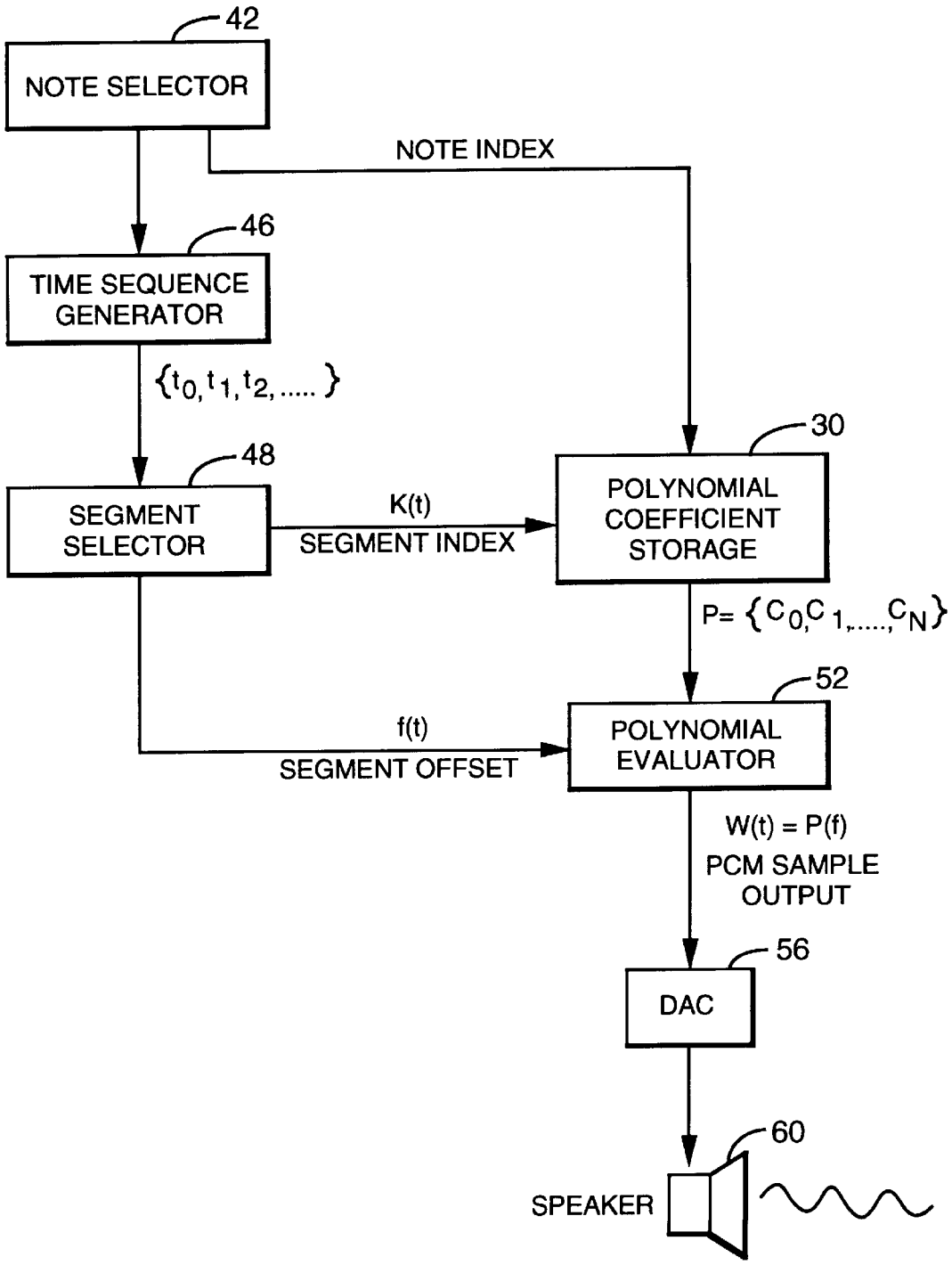
FIG. 8*b* shows an apparatus for same.

The corresponding playback apparatus is shown in a block diagram in FIG. 8*b*, most portions of which are conventional. This apparatus may be embodied in hardware or software or a combination thereof. The first portion of the apparatus is the note selector 42 which is conventional and, for instance, is a standard MIDI controller. The note selector 42 outputs a note index to the polynomial coefficient storage 30 which is the same element as shown in FIG. 6. Also, the note selector 42 is coupled to the time sequence generator 46 which is conventional and outputs times $t_0$, $t_i$, . . . to segment selector 48. The segment selector 48 outputs a segment index K(t) to the polynomial coefficient storage 30 and also the segment offset f(t), as described above, to the polynomial evaluator 52. The polynomial evaluator 52 also receives the polynomial coefficients from polynomial coefficient storage 30. These coefficients are $C_0$, $C_1$, . . . etc. The polynomial evaluator 52 then calculates the waveform w(t)=P(t), in other words, calculates a PCM sample digital output signal. This output signal is then converted by conventional digital analog converter 56 to an analog signal which in turn drives a loudspeaker or headphones 60 outputting a sound audible to the human ear.

Figure 9A:
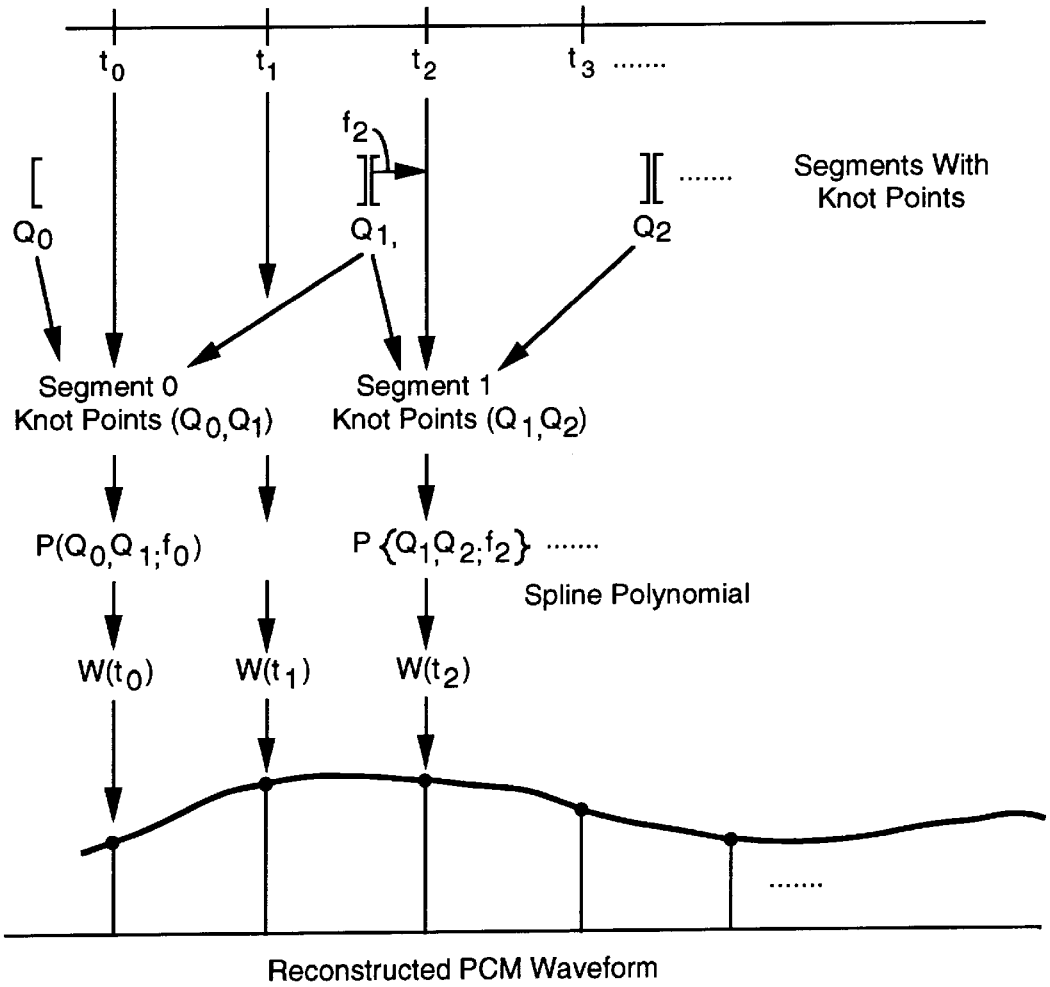
FIG. 9*a* shows graphically playback of a spline encoded signal.

A corresponding playback process for the spline fitted wavefunction is shown in FIG. 9*a* which corresponds in most respects to FIG. 8*a* except that here the symbol "Q" is used for the splines rather than "P" for polynomial. Again, as shown this results in the reconstructed PCM waveform shown at the bottom of FIG. 9*a*. Note that here the segments are distinguished by the presence of the knot points.

Figure 9B:
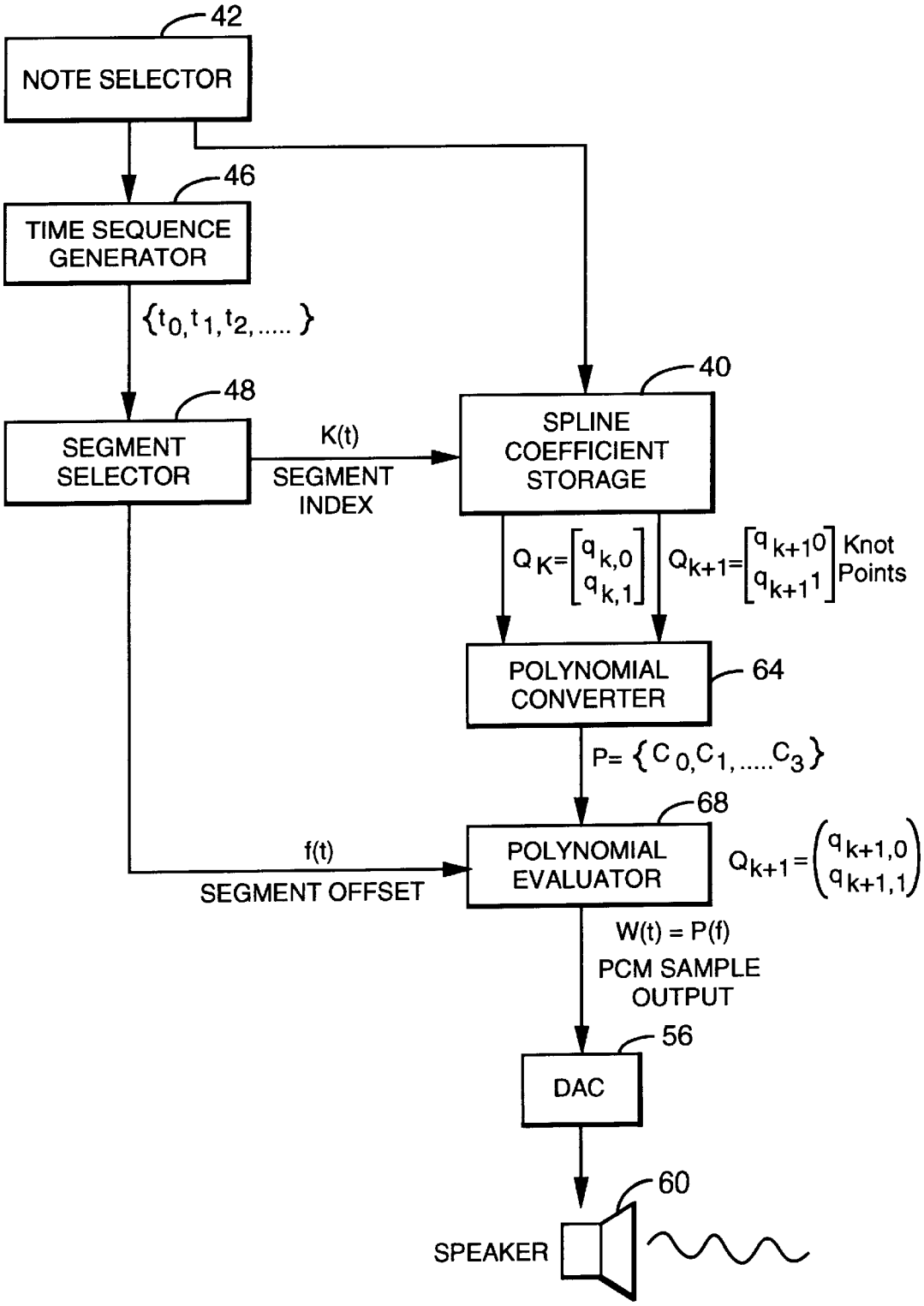
FIG. 9*b* shows an apparatus for same.

A corresponding spline playback apparatus as shown in FIG. 9*b* includes a number of elements similar to those of FIG. 8*b*, identified by similar reference numbers. Here, instead of the polynomial coefficient storage 30 of FIG. 8*b*, there is substituted the spline coefficient storage 40 of FIG. 7. Storage 40 in turn supplies the spline coefficients to the polynomial converter 64 which outputs the polynomial value coefficient. Converter 64 in turn is coupled to the polynomial evaluator 68 which also receives the segment offset values f(t) and the PCM sample output of which drives the digital analog converter 56. It is to be understood that the coefficients having been generated, they are stored for later use by the playback apparatus.

To summarize, wavefunction synthesis has many advantages over traditional PCM resampling synthesis, including near-perfect "brick-wall" reconstruction near the Nyquist frequency, now-cost sample reconstruction, and absence of a filter coefficient table.

This description is partly in terms of equations and signal processing expressed as equations. It is to be understood that a physical embodiment of an apparatus for carrying out this processing would typically be as described above in the form of computer code to be executed by, e.g., the Intel MMX type or similar processors. Writing such code in light of this description would be well within the skill of one of ordinary skill in the art. Of course this is not the only embodiment for the method and process in accordance with this invention and other embodiments are possible, for instance dedicated hardware or other computer software versions for execution on other types of multi-media processors or general purpose microprocessors.

Applications of this invention are not limited to music but also include speech and other sound synthesis. Generally, applications are to any digital audio synthesis where there is resampling synchronization between the source and destination.

This disclosure is illustrative and not limiting; further modifications will be apparent to one skilled in the art in light of this disclosure and are intended to fall within the scope of the appended claims.

I claim:

1. A method for producing a sound, comprising the acts of:

defining a sequence of time points;

associating a polynomial with each time point;

calculating a sample value for each time point by evaluating the associated polynomial; and providing the calculated sample values in the sequence to generate the sound.

2. The method of claim 1, further comprising, for each of a sequential number of time points, the acts of setting an equal interval between the time points, and setting a predetermined degree of the polynomial.

3. The method of claim 1, further comprising the act of assigning an index to each of the time points, the index indicating the length between time points and the degree of the polynomial.

4. The method of claim 1, further comprising the act of representing each of the polynomials as a spline.

5. The method of claim 4, wherein the spline is a cubic spline.

6. The method of claim 1, further comprising the act of selecting each of the polynomials to fit a predetermined signal.

7. The method of claim 6, wherein the predetermined signal is a pulse code modulated signal.

8. The method of claim 6, wherein the predetermined signal is an upsampled signal.

9. The method of claim 8, wherein the upsampling of the signal is by a factor of at least $\sqrt{2^N}$ where N is a predetermined number of bits of accuracy.

10. The method of claim 1, wherein the method does not include any polyphase filtering.

11. The method of claim 1, wherein the sound is a sampled numerical tone.

12. The method of claim 1, where the polynomial is normalized over a predetermined time interval.

13. A method of producing a sound, comprising the acts of:

providing an input waveform;

segmenting the input waveform at segmentation points into a plurality of segments;

fitting a polynomial to each segment; and storing coefficients of the polynomial for later reproduction of the input waveform.

14. The method of claim 13, further comprising, for each of a sequential number of the time points, the act of setting an interval between the time points as being equal, and associating a polynomial of the same degree.

15. The method of claim 13, further comprising the act of assigning an index to each sequential number of the time points, the index indicating the length and degree of the polynomial fitted to each segment.

16. The method of claim 13, further comprising the act of representing each of the polynomials as a spline.

17. The method of claim 16, wherein the spline is a cubic spline.

18. The method of claim 13, further comprising the act of selecting each of the polynomials to fit a predetermined signal.

19. The method of claim 18, wherein the predetermined signal is a pulse code modulated signal.

20. The method of claim 18, wherein the predetermined signal is an upsampled signal.

21. The method of claim 20, wherein the upsampling of the signal is by a factor of at least $\sqrt{2^N}$ where N is a predetermined number of bits of accuracy.

22. An apparatus for encoding an input waveform, comprising:

a time segment segmenter which receives the input waveform and defines a time segment length;

a waveform segmenter coupled to the time segment segmenter and which segments the input waveform at segmentation points defined by the time segment length;

a polynomial fitter coupled to the waveform segmenter and which fits a polynomial having a plurality of coefficients to each waveform segment; and a storage element coupled to the polynomial fitter, and which stores the coefficients of the polynomials.

23. The apparatus of claim 22, wherein the segmentation points are at equal time intervals.

24. The apparatus of claim 22, wherein the waveform segmenter assigns an index to each of the segment points, the index indicating the length and degree of the polynomial fitted to each segment.

25. The apparatus of claim 22, wherein the polynomial is a spline.

26. The apparatus of claim 25, wherein the spline is a cubic spline.

27. The apparatus of claim 22, wherein the input waveform is a pulse code modulated signal.

28. An apparatus for playing back a sound, comprising:

a note selector;

a time segment generator coupled to the note selector;

a segment selector coupled to the time segment selector;

a storage element holding coefficients and coupled to the note selector and segment selector, thereby to output the coefficients representing a note selected by the note selector;

a polynomial evaluator coupled to the storage element; and a digital to analog converter coupled to the polynomial evaluator.

29. The apparatus of claim 28, wherein the stored coefficients are coefficients of a polynomial.

30. The apparatus of claim 28, wherein the stored coefficients are spline coefficients, and further comprising a polynomial converter coupled between the storage element and the polynomial evaluator.

31. The apparatus of claim 30, wherein the spline coefficients are cubic spline coefficients.

32. The apparatus of claim 28, wherein each of the coefficients is associated with a time point of the sound.

33. The apparatus of claim 32, wherein the time points are at equal intervals, and each polynomial is of a predetermined degree.

34. The apparatus of claim 32, wherein each coefficient has an assigned index indicating the length between time points and the degree of the polynomial.

35. The apparatus of claim 33, wherein each polynomial is normalized over a predetermined time interval.

36. The apparatus of claim 28, wherein the sound is digitally encoded from an original sound and is played back at a particular rate differing from that of the original sound, whereby a range of musical note pitches can be played back from a single digitally encoded original sound.

37. The apparatus of claim 28, wherein the sound is digitally encoded from an original sound having a predetermined pitch and encoded at a first sample interval, and the sound is played back at a second sample interval and the predetermined pitch.

* * * * *